US011242196B2

(12) United States Patent
Grigsby, III et al.

(10) Patent No.: US 11,242,196 B2
(45) Date of Patent: Feb. 8, 2022

(54) TRANSPORT SHIPPING CONTAINER FOR PERSONAL WATERCRAFT

(71) Applicant: UFP Industries, Inc., Grand Rapids, MI (US)

(72) Inventors: John M Grigsby, III, Woodstock, GA (US); Carl D Prentice, Lawrenceburg, TN (US)

(73) Assignee: UFP Industries, Inc., Grand Rapids, MI (US)

( * ) Notice: Subject to any disclaimer, the term of this patent is extended or adjusted under 35 U.S.C. 154(b) by 423 days.

(21) Appl. No.: 16/222,828

(22) Filed: Dec. 17, 2018

(65) Prior Publication Data

US 2019/0193930 A1 Jun. 27, 2019

Related U.S. Application Data

(60) Provisional application No. 62/608,809, filed on Dec. 21, 2017.

(51) Int. Cl.

| | |
|---|---|
| ***B65D 88/12*** | (2006.01) |
| ***B65D 90/14*** | (2006.01) |
| ***B65D 90/00*** | (2006.01) |
| ***B65D 85/68*** | (2006.01) |

(52) U.S. Cl.

CPC ..... *B65D 88/129* (2013.01); *B65D 85/68* (2013.01); *B65D 90/006* (2013.01); *B65D 90/14* (2013.01)

(58) Field of Classification Search

CPC .... B65D 88/129; B65D 85/68; B65D 90/006; B65D 90/14; B66F 7/22; B63B 35/40; B63B 27/36

USPC ..... 206/386; 280/414.1, 139.9, 258; 108/8, 108/12, 17, 7, 11

See application file for complete search history.

(56) References Cited

U.S. PATENT DOCUMENTS

| | | | | |
|---|---|---|---|---|
| 2,558,418 A | | 6/1951 | Brueckman | |
| 3,026,981 A | | 3/1962 | Youtie | |
| 4,792,041 A | | 12/1988 | Grigsby | |
| 4,813,843 A | * | 3/1989 | Gilmour | B66F 7/22 254/94 |
| 5,228,713 A | * | 7/1993 | Kovach | B60P 3/1033 280/414.1 |
| 5,275,279 A | | 1/1994 | Grigsby | |
| 5,772,026 A | | 6/1998 | Grigsby | |

(Continued)

FOREIGN PATENT DOCUMENTS

GB 2276860 A 12/1994

OTHER PUBLICATIONS

PCT/US2018/0666074, International Search Report (dated Mar. 25, 2019).

PCT/US2018/0666074, Written Opinion (dated Mar. 25, 2019).

*Primary Examiner* — J. Gregory Pickett

*Assistant Examiner* — Tia Cox

(74) *Attorney, Agent, or Firm* — Baker, Donelson, Bearman, Caldwell & Berkowitz, PC; Carl M. Davis, II

(57) ABSTRACT

A shipping container for a personal watercraft, in which a first and second pair of roller guides attach to a pallet for removably receiving a pair of trusses that support a personal watercraft thereon, the trusses movable between a first position for loading or unloading the personal watercraft and a second position for storing and transporting of the personal watercraft at an oblique angle. A method of containing a personal watercraft in a shipping container is disclosed.

34 Claims, 8 Drawing Sheets

(56) References Cited

U.S. PATENT DOCUMENTS 5,890,835 A * 4/1999 Basta ..... B63C 3/06 405/3
6,250,050 B1 6/2001 Grigsby, Sr.
6,257,167 B1 * 7/2001 Joaquim ..... B60P 3/1033 114/344
6,520,728 B1 * 2/2003 Schwitters ..... B63C 3/02 114/44
6,585,126 B1 7/2003 Grigsby, Sr.
6,694,894 B1 * 2/2004 Darnell ..... B65D 88/129 108/53.1
6,719,317 B1 * 4/2004 Grovender ..... B60P 3/1033 280/414.1
6,722,683 B1 * 4/2004 Heuiser ..... B60P 1/165 280/414.1
6,938,557 B1 9/2005 Grigsby, Jr.
7,011,223 B1 3/2006 Grigsby, Sr.
7,055,449 B2 * 6/2006 Brown ..... B60P 3/1066 114/219
7,112,007 B2 * 9/2006 Maffett ..... B63C 15/00 405/3
8,511,495 B2 8/2013 Grigsby
8,596,946 B2 12/2013 Lydle
9,758,223 B1 * 9/2017 Gagno ..... B63B 27/143
2003/0150757 A1 * 8/2003 Dunn ..... B65D 19/385 206/335
2004/0247422 A1 * 12/2004 Neumann ..... B65D 88/14 414/529
2008/0135546 A1 * 6/2008 Smith ..... B65D 90/18 220/1.5
2012/0074012 A1 * 3/2012 Crane ..... B65D 19/12 206/386
2013/0056955 A1 * 3/2013 Granlind ..... B60P 3/1091 280/414.1
2018/0147970 A1 5/2018 Lasley

* cited by examiner

TRANSPORT SHIPPING CONTAINER FOR PERSONAL WATERCRAFT

This application claims benefit of U.S. Provisional Patent Application Ser. No. 62/608,809, filed Dec. 21, 2017, with the United States Patent and Trademark Office, and incorporates same by reference.

TECHNICAL FIELD

The present invention relates to containers for storing and transporting personal watercraft. More particularly, the present invention relates to a transport shipping container that meets manufacturer and watercraft retailer needs for shipping containers readily usable in storing and shipping personal watercraft to remote retailers while facilitating the crating and the unloading of personal watercraft at the manufacturers and at the retailers.

BACKGROUND OF THE INVENTION

Personal watercraft are increasingly popular for recreational activities. Over the years since introduction, the various models of personal watercraft have changed in size and performance. A manufactured watercraft is packaged in a palletized container for warehouse storage and for shipping by truck from a manufacturer to retailer. Initially, such watercraft were placed in containers that allowed two to be placed side-by-side in a section of a truck and two additional containers stacked on top.

The watercraft however have changed from initial small-beam powered craft to single and multiple seating powerful watercraft having larger beam widths and longer aft-to-stern lengths. The increased beam provides stability for the larger multi-passenger personal watercraft.

The increased beam, or maximum width, of newer models of personal watercraft however poses transport problems. Because domestic (U.S.) truck trailers typically provide about 96-98 inches usable transverse space (nominal 102 inch wide trailers), pallet containers have a maximum of 48 inches width in order to maintain usage at two containers positioned side-by-side in a trailer. A single pallet container leaves significant space that typically is filled with buffer material to restrict movement of the container during transport. However, transport of watercraft in single pallet container loading (rather than side-by-side container transport) increases shipping costs. Export containers are more restrictive with a maximum width of 45 inches for side-by-side positioning in a 90-92 inch usable storage width (nominal 98 inches).

The industry resolved this transport problem by mounting personal watercraft on angled supports of about 40-48 degrees. This positioned a horizontal axis of the personal watercraft at an angle to the pallet that sits parallel to the floor of the trailer. The angled positioning accommodated the larger beam watercraft.

The use of angled support containers however lead to uncrating problems at retailers. The personal watercraft is heavy, long and wide, and can be 1400 pounds or more, with 10-12 foot lengths and 48 inch beams. Retailers generally lack lifting equipment to engage the watercraft angled on the pallet, and then, support and lift the watercraft to a horizontal orientation, and remove the watercraft from the pallet for placing on a wheeled dolly to move to a display or to a body of water.

There is a need in the industry for shipping containers that are readily usable in trucking to remote retailers of personal watercraft mounted at an angled orientation relative to a pallet of the shipping container while facilitating the handling of the personal watercraft at a horizontal orientation for creating for storage and shipping and uncrating of the watercraft for display and sale. It is to such that the present invention is directed.

BRIEF SUMMARY OF THE INVENTION

The present invention meets the need in the industry for a shipping container for personal watercraft readily trucked to remote retailers, which mounts the personal watercraft at an angled orientation relative to a pallet of the shipping container while facilitating the handling of the personal watercraft at a horizontal orientation for crating and uncrating of the personal watercraft for shipment and for display and sale. More particularly, the shipping container of the present invention comprises a shipping container, comprising a pallet and a first pair of roller guides and a second pair of roller guides attached in spaced apart relation intermediate opposing ends of the pallet. Each of the roller guides comprises a pair of spaced-apart plates, a shaft extending between the plates, and a sleeve received on the shaft for axial rotation. A pair of trusses are each removably received on a respective one of the roller guides of the first pair of roller guides and the second pair of roller guides, whereby the trusses are movable on the respective sleeves that rotate during movement of the truss between a first position for loading or unloading the personal watercraft seated on the trusses and a second position for storing and transporting of the personal watercraft thereon.

In another aspect, the present invention provides a method of containing a personal watercraft in a shipping container for storage and shipping, comprising the steps of:

(a) providing a pallet having a first pair of roller guides and a second pair of roller guides, the first pair and the second pair of the roller guides attached in spaced apart relation intermediate opposing ends of the pallet, each of the roller guides comprises a pair of spaced-apart plates, a shaft extending between the plates, and a sleeve received on the shaft for axial rotation;

(b) placing one of a pair of trusses on a respective one of the first pair of roller guides and the second pair of roller guides in a first position for loading or unloading the personal watercraft thereon, the trusses movable on the sleeves from the first position to a second position for orienting a transverse axis of the personal watercraft at an oblique angle relative to the pallet for storing and transporting of the personal watercraft seated on the trusses; and (c) securing the personal watercraft received on the trusses to the pallet.

In another aspect, the present invention provides a shipping container, comprising a pallet having a first pair of roller guides and a second pair of roller guides, the first pair and the second pair of roller guides spaced apart intermediate opposing ends of the pallet and a pair of trusses each removably received on a respective one of the first pair of roller guides and the second pair of roller guides. Each truss comprises a rail and a chock connected in spaced relation by at least one span. The rail travels on the roller guides, whereby the trusses are movable from a first position for loading or unloading the personal watercraft seated on the trusses and a second position for storing and transporting of a personal watercraft thereon at an oblique angle relative to the pallet.

In yet another aspect, the present invention provides a shipping container, comprising a pallet and a first pair of roller guides and a second pair of roller guides, the first pair and the second pair of roller guides spaced apart intermediate opposing ends of the pallet, and a pair of trusses each removably received on a respective one of the first pair of roller guides and the second pair of roller guides. The trusses movable from a first position for loading or unloading the personal watercraft seated on the trusses and a second position for storing and transporting of a personal watercraft thereon at an oblique angle relative to the pallet. A pair of resilient pads, each disposed on a respective one of the pair of trusses, cushioningly contacting an exterior surface of the personal watercraft.

In yet another aspect, the present invention provides a shipping container, comprising a pallet and a first pair of roller guides and a second pair of roller guides, the first pair and the second pair of roller guides spaced apart intermediate opposing ends of the pallet, and a pair of trusses each removably received on a respective one of the first pair of roller guides and the second pair of roller guides. The trusses movable from a first position for loading or unloading the personal watercraft seated on the trusses and a second position for storing and transporting of a personal watercraft thereon at an oblique angle relative to the pallet. A stern brace comprising an arm extends from the pallet and having a stern pad attached at a free distal end for bearing contact against a stern of the personal watercraft, for resisting movement of the personal watercraft during handling and shipping of the shipping container.

In yet another aspect, the present invention provides a shipping container, comprising a pallet and a first pair of roller guides and a second pair of roller guides, the first pair and the second pair of roller guides spaced apart intermediate opposing ends of the pallet, and a pair of trusses each removably received on a respective one of the first pair of roller guides and the second pair of roller guides. The trusses movable from a first position for loading or unloading the personal watercraft seated on the trusses and a second position for storing and transporting of a personal watercraft thereon at an oblique angle relative to the pallet. A pair of opposing end frames attach to respective ends of the pallet, and a top frame attaches to the end frames. A plurality of side support members disposed in spaced apart relation on opposing longitudinal sides between the opposing ends of the pallet connect at respective ends to the pallet and the top frame, and wherein at least one of the side support members on each of the opposing sides is disposed at an oblique angle relative to the pallet.

In yet another aspect, the present invention provides a shipping container, comprising a pallet and a first pair of roller guides and a second pair of roller guides, the first pair and the second pair of roller guides spaced apart intermediate opposing ends of the pallet, and a pair of trusses each removably received on a respective one of the first pair of roller guides and the second pair of roller guides. The trusses movable from a first position for loading or unloading the personal watercraft seated on the trusses and a second position for storing and transporting of a personal watercraft thereon at an oblique angle relative to the pallet. A pair of opposing end frames attach to respective ends of the pallet and a top frame attaches to the end frames. A plurality of elongate support members each attach at an oblique angle relative to the pallet at respective opposing ends to one of the end frames and to the pallet.

Objects, advantages, and features of the present invention will become apparent upon a reading of the following detailed description in conjunction with the drawings and the appended claims.

DETAILED DESCRIPTION

Figure 1:
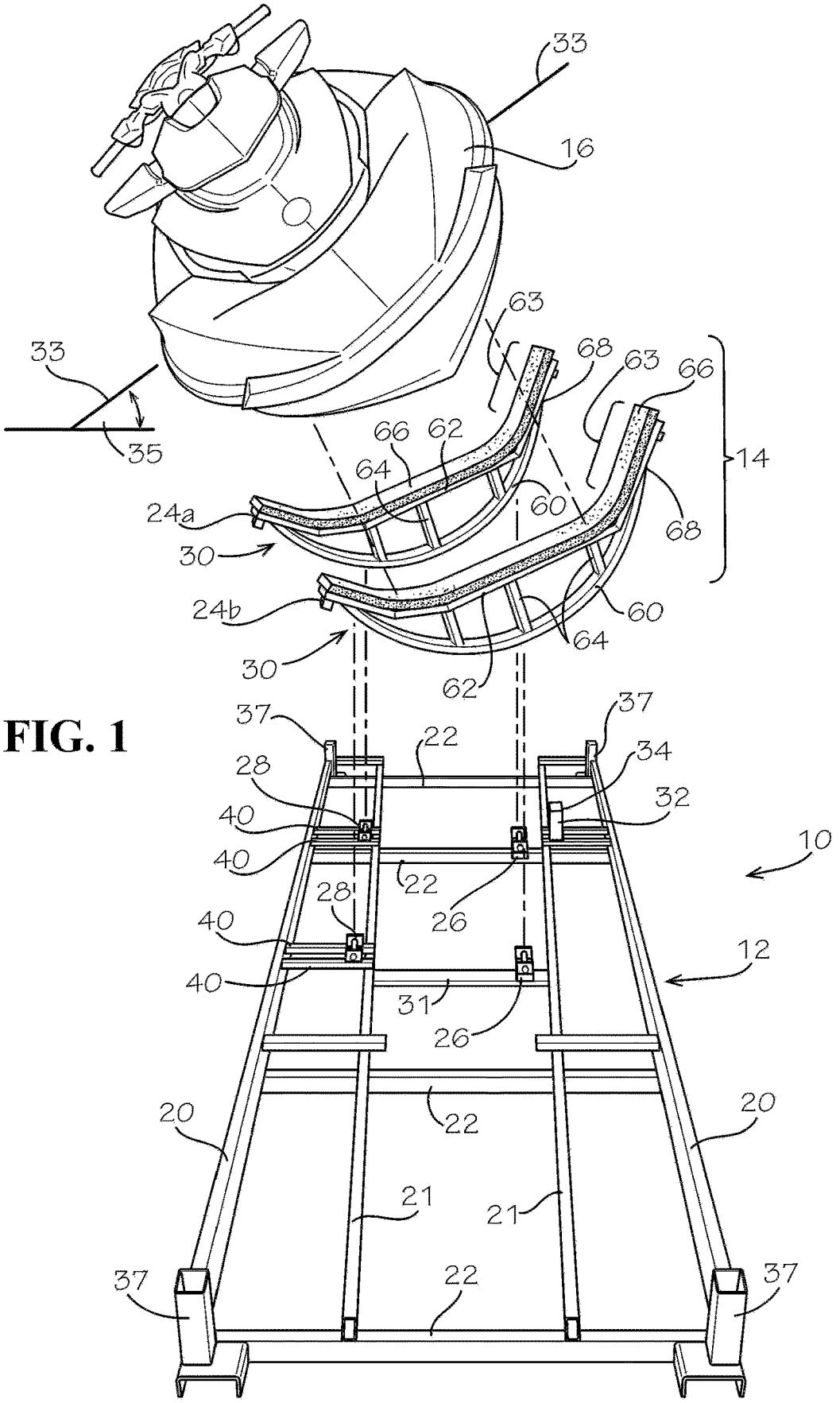
FIG. 1 illustrates perspective exploded view a pallet and a cradle in an orientation for supporting a personal watercraft in a shipping container for shipping and storage in accordance with the present invention.

With reference to the drawings in which like parts have like identifiers throughout the several views, FIG. 1 illustrates in perspective exploded view a shipping container 10 having a pallet 12 and a cradle generally 14 for supporting a personal watercraft 16 in accordance with the present invention for storage and transport from a manufacturer to a watercraft retailer. FIG. 1 illustrates the personal watercraft 16 exploded away from the cradle 14 with each in an oblique orientation for supporting the personal watercraft in the shipping container. This orientation disposes a transverse axis 33 of the personal watercraft 16 at an oblique angle 35 relative to the pallet 12. This provides the shipping container 10 with a narrower width and a taller height than would be required for containing the personal watercraft 16 oriented with the transverse axis in a plane substantially parallel with the pallet 12. The shipping container 10 meets the need for a shipping container readily usable for storage and for shipping of the personal watercraft 16 to remote retailers while facilitating the loading or crating of the personal watercraft at the manufacturer and the unloading at the retailer location for display and sale of the personal watercraft to customers.

Figure 9:
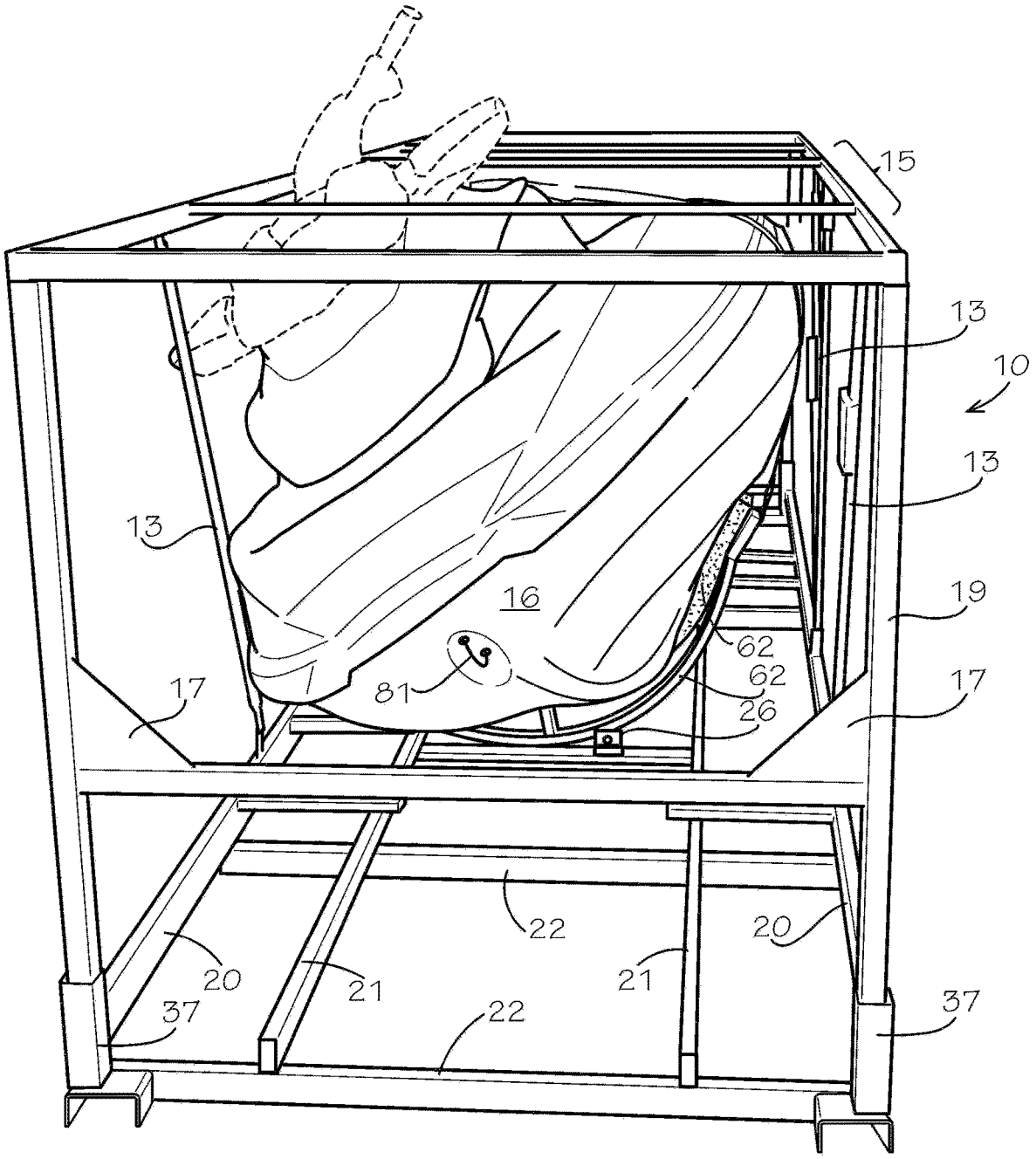
FIG. 9 illustrates a bow view of the shipping container for the personal watercraft having opposing H-frame end supports, side support members, and a top frame.

The pallet 12 includes spaced-apart elongated outer members 20 and inner members 21 connected by transverse members 22 to define a rigid base. The members in the illustrated embodiment are elongate steel tubes that weld together to form the pallet 12. An open end tube attaches as receiver 37 at respective outside distal corners of the pallet 12. As illustrated in FIG. 9, the shipping container 10 has a top frame 15 and side support members and end members, such as the illustrated elongated side support members 13

(attached to the pallet and top frame on opposing sides as diagonal members and vertical members) and the opposing H-shaped end panel assemblies 19. The receivers 37 receive leg members of the end panel assembly to support the ends and the top frame that seat on the upper end. Gussets 17 provide additional rigidity for the framing of the shipping container 10. The elongated side support members 13 connect between the pallet 12 and the top frame 15, or alternatively, connect as diagonal supports between the end panels 19 and the pallet 12.

With continuing reference to FIG. 1, the cradle 14 comprises a pair of hull cradles generally 24 positioned in spaced-apart relation intermediate the opposing ends of the pallet 12. One hull cradle 24*a* is positioned towards one end of the pallet 12 for support of an aft portion of the personal watercraft 16 and a second hull cradle 24*b* is positioned spaced-apart towards an opposing end of the pallet for support of a mid-section portion of the personal watercraft intermediate the opposing ends of the pallet.

The hull cradles 14 each include a pair of guides 26, 28 and a truss 30 for supporting the watercraft. The respective guides 26, 28 for the hull cradle 24 are positioned relative to the pallet 12 in transverse alignment and spaced apart, preferably on opposing sides of a longitudinal axis of the pallet. The truss 30 travels on the guides 26, 28 to move between a first position and a second position. The truss 30 in the first position enables loading of the personal watercraft 16 onto the truss and for unpacking of the personal watercraft from the shipping container. The truss 30 in the first position orients the transverse axis 33 of the personal watercraft 16 parallel to the pallet 12 for loading of the personal watercraft onto the shipping container and for unpacking of the personal watercraft from the shipping container. The truss 30 in the second position enables storage and shipping of the personal watercraft 16. The truss 30 in the second position orients the transverse axis 33 of the personal watercraft 16 at the oblique angle 35 relative to the pallet 12 for storage and shipping.

For the intermediate hull cradle 24*b*, the guide 26 mounts to a transverse member 31 extending between opposing inner members 21 of the pallet 12, or alternatively depending on size of the watercraft, between one of the inner members 21 and the adjacent outer member 20. For the aft hull cradle 24*a*, the guide 26 attaches to one of the transverse members 22. The guide 26 mounts between a central longitudinal axis of the pallet and the inner member 21 on a first side of the pallet. In the illustrated embodiment, the guides 26 attach closer to a longitudinal axis of the pallet 12 than to the lateral outer extent of the pallet. At least one stop member 32 extends upwardly from the inner member 21 proximate one of the guides 26 to a free distal end 34. The stop member 32 defines a stop at the distal free end 34.

On the opposite side of the pallet 12, a pair of transverse members 40 connect to the other outer member 20 and the adjacent opposing inner member 21. The pair of transverse members 40 are provided for each of the guides 28. The guide 28 attaches to the transverse members 40. This positions the guide 28 on the opposing side of the pallet 12 intermediate the longitudinal axis and the other outer member 20. In the illustrated embodiment, the guides 28 mount closer to the lateral outer extent than to the longitudinal axis. The guide 28 may be positioned vertically higher than the guide 26. An alternate embodiment may use one member 40 for each guide 28.

Figure 2:
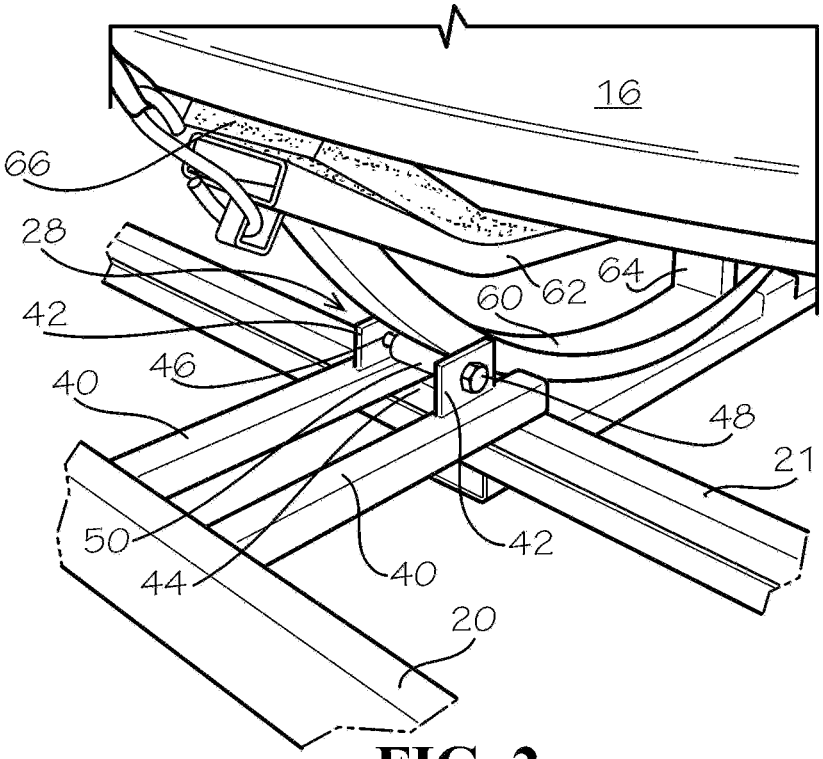
FIG. 2 illustrates in perspective detail view a bow truss seated on a guide of the pallet illustrated in FIG. 1, for supporting a forward portion of the personal watercraft.
Figure 3:
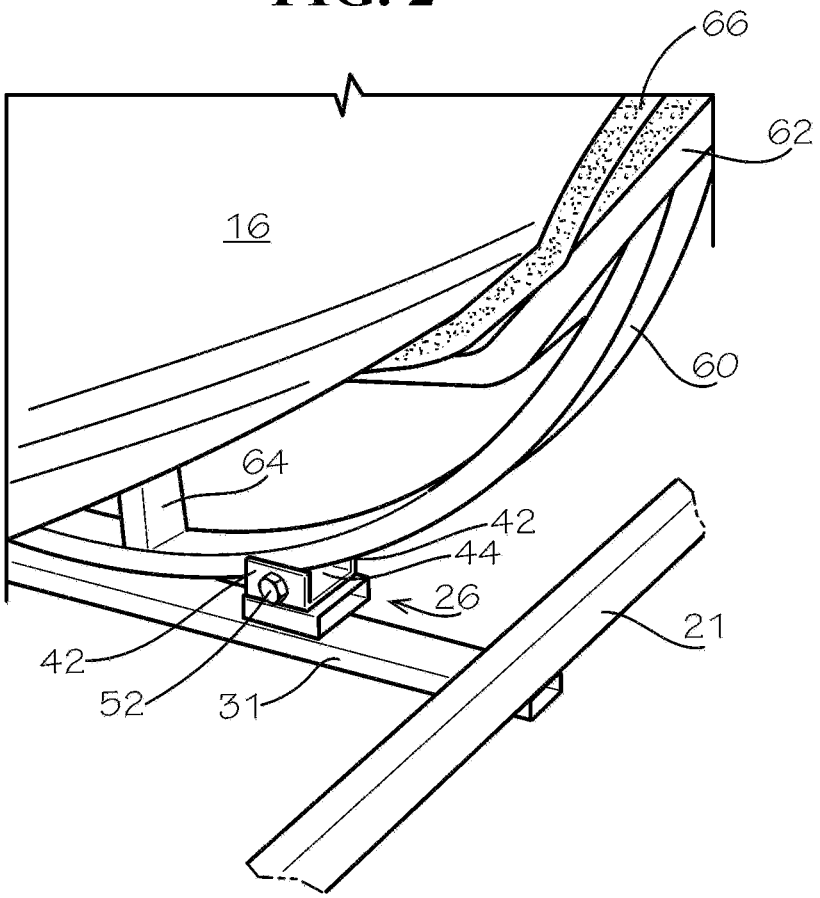
FIG. 3 illustrates in perspective detail view an aft truss seated on a guide of the pallet illustrated in FIG. 1, for supporting a stern portion of a personal watercraft.

As illustrated in FIGS. 2 and 3, the guides 26, 28 are U-shaped brackets having opposing walls 42 and a base 44. The base 44 rigidly secures to the transverse member 32 (or to the transverse members 40). The opposing walls 42 define aligned openings 46. A portion of the walls 42 extends upwardly as guide surfaces. A shaft, such as a threaded bolt 48, extends through the openings 46 and receives a cylindrical sleeve 50 between the walls 42. A nut 52 secures the bolt 48. The sleeve 50 on the bolt 48 thereby forms an axially rotatable thrust bearing.

With returning reference to FIG. 1, the trusses 30 seat on the guides 26, 28 to support the watercraft 16. The truss 30 seats in the guides 26, 28 for movement of the truss relative to the guides between the second position to orient the watercraft at the oblique angle relative to the pallet for storage and shipping of the container and the first position to orient the watercraft at horizontal relative to the pallet for crating and for unpacking.

Each truss 30 comprises an arcuate rail 60 and a spaced-apart chock 62 connected by at least one spans 64. The chock 62 rigidly connects 68 proximate the distal end portions to respective ends of the rail 60. A resilient pad 66 attaches to the chock 62 for cushioning the contact of the hull of the personal watercraft 16 with the truss 30. The chock 62 conforms in shape to a transverse cross-sectional exterior portion of the hull of the personal watercraft 16. The hull of the watercraft 16 thereby seats on the pad 66 for cushioned support on the truss 30. The chock 62 includes distal end portions 63 that extend at an angle. The distal end portions 63 thereby extend alongside a respective side wall of the watercraft 16 when positioned on the truss 30. An end of the distal end portion 63 bears on the stop 34 of the stop member 32 when the truss 30 moves to the first position.

The arcuate rail 60 in the illustrated embodiment has a 17 inch radius to an inner diameter and an 18 inch radius to an outer diameter. The resilient pad 66 is a cross-linked polyethylene foam (certified for Class A surface contact), of about 4 pounds per cubic foot density volumetric weight, or other suitable cushion material to restrict scratching or surface damage to the hull of the watercraft during transport and handling.

FIG. 2 illustrates a detailed view of one of the guides 28 and the truss 30 that seats in the guide for movement of the truss relative to the guide between the first position to orient the watercraft horizontal relative to the pallet 12 for crating and for unpacking and the second position at the oblique angle relative to the pallet for storage and shipping of the container and the watercraft. The truss 30 moves on the guides 26, 28 between the first and second positions, as discussed below.

FIG. 3 illustrates a detailed view of the hull cradle 24*b* with the truss 30 that seats on the guide 26 attached to the pallet for supporting the intermediate portion of the personal watercraft 16 in the shipping container 10.

Figure 4:
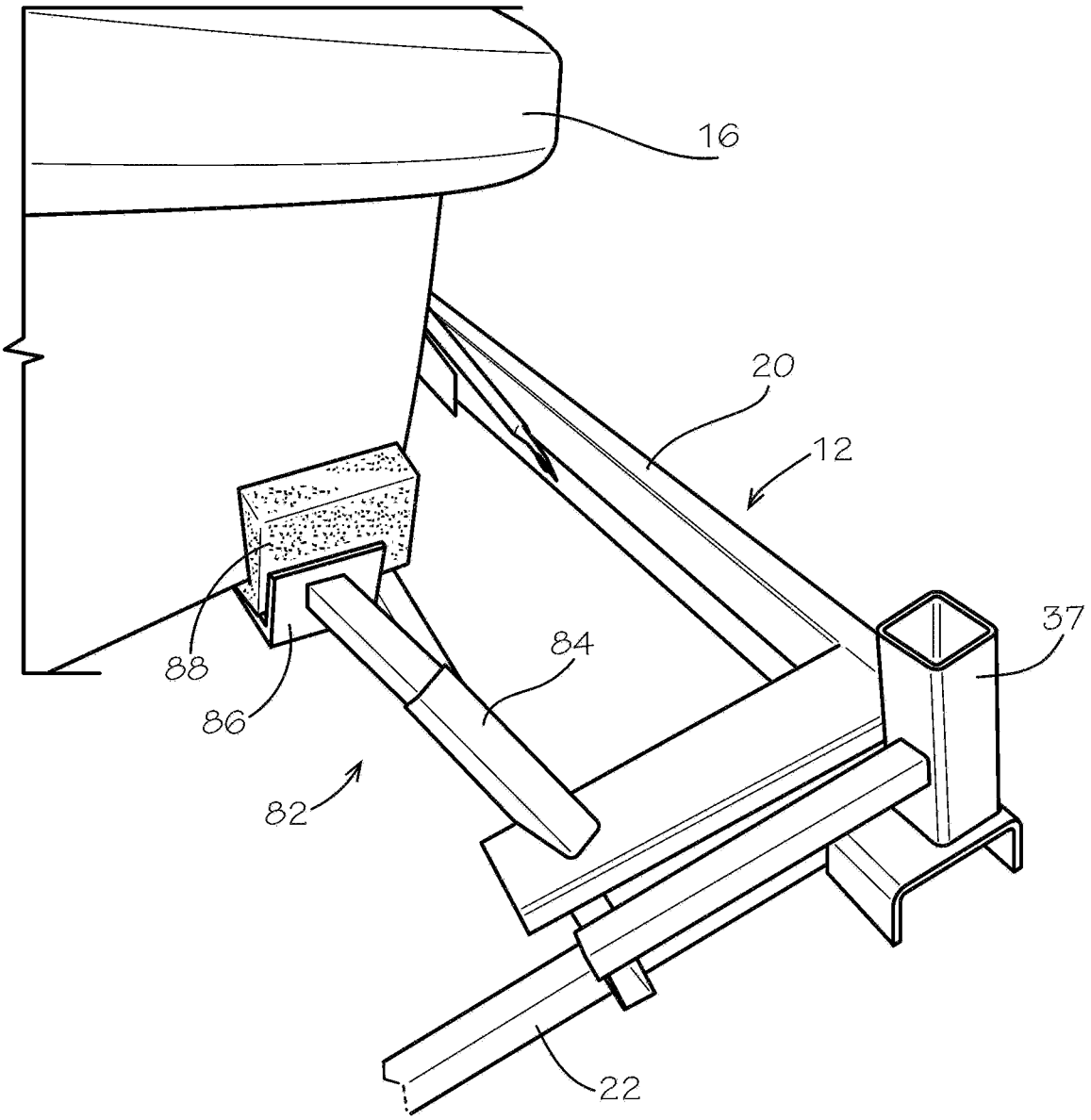
FIG. 4 illustrates in perspective detail view a stern brace for securing a personal watercraft on the pallet of the shipping container illustrated in FIG. 1.

FIG. 4 illustrates a detailed stern view showing a stern brace 82, or chock, extending between the end of the pallet 12 and the stern of the watercraft 16 to restrict rearward movement of the watercraft during shipping and handling of the shipping container 10. The stern brace 82 comprises an arm 84 extending from the pallet to an end plate 86 and a resilient pad 88 seats between the end plate 84 and the stern of the watercraft 16. The end plate 86 in the illustrated embodiment comprises an L-shaped seat having a first leg for extending underneath a portion of the stern of the personal watercraft and a second leg for facing the stern; and the resilient pad 88 connected to the seat for contacting respective portions of the stern of the personal watercraft 16.

Figure 5:
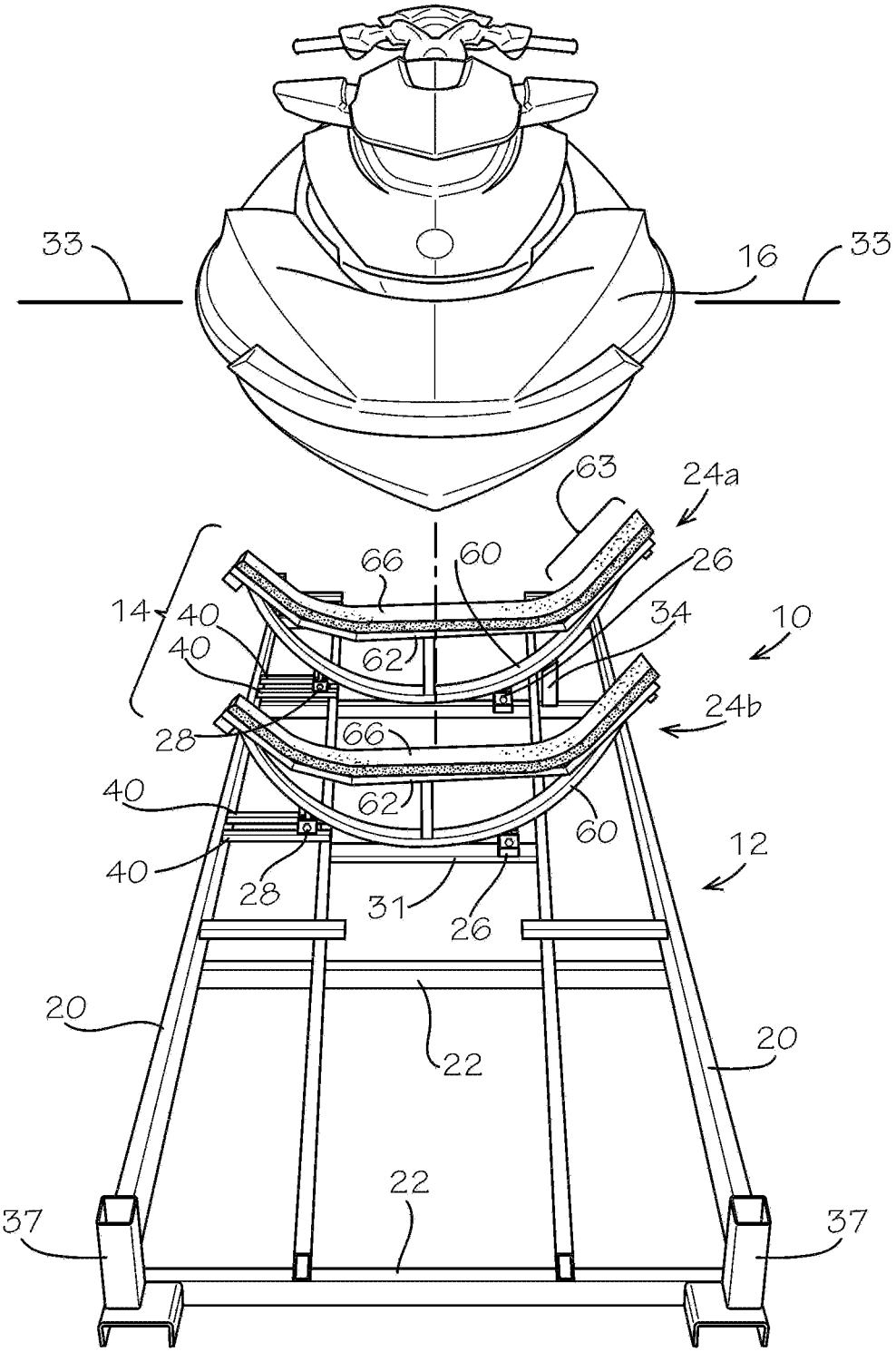
FIG. 5 illustrates in perspective exploded view the shipping container illustrated in FIG. 1 with the cradle in a first position for loading and unloading of the personal water craft.

FIG. 5 illustrates the personal watercraft 16 exploded from the pallet 12 with the trusses 30 in the first position for supporting the watercraft 16 in the horizontal orientation relative to the pallet during the loading process for storage and shipping or during the unpacking process to remove the personal watercraft from the shipping container. The distal ends of the truss 30 angle upwardly to be disposed adjacent the side wall of the personal water craft 16.

Figure 6:
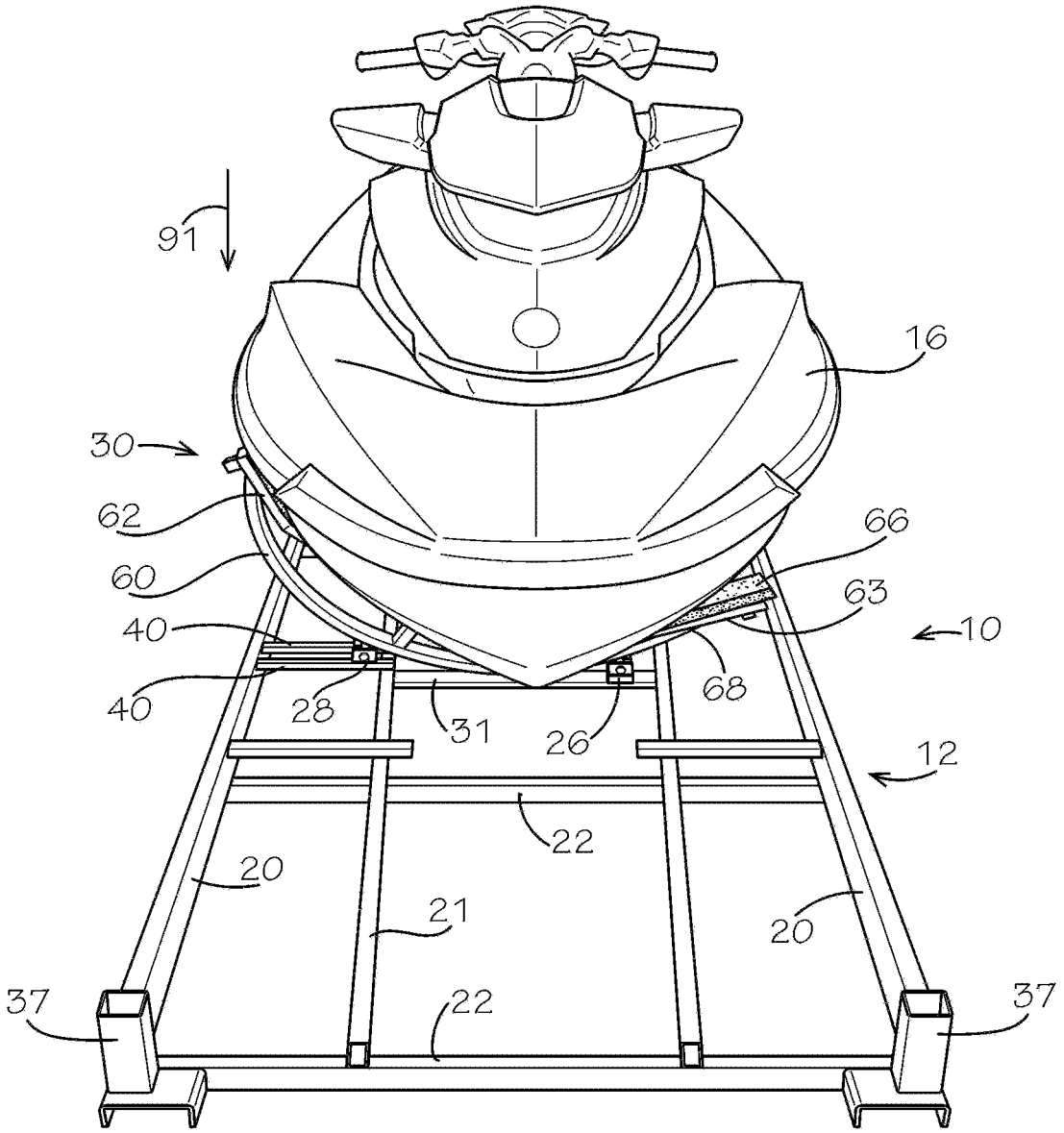
FIG. 6 illustrates a bow view of the personal watercraft on the pallet of the shipping container illustrated in FIG. 1.

FIG. 6 illustrates a bow or front view of the pallet 12 in the first orientation or position for loading or for unpacking of the personal watercraft 16. (The H-frame opposing end braces 19, the side support members 13, and the top frame 15 (shown in FIG. 9) are installed during crating and removed from the pallet 12 during the unpacking process.)

Figure 7:
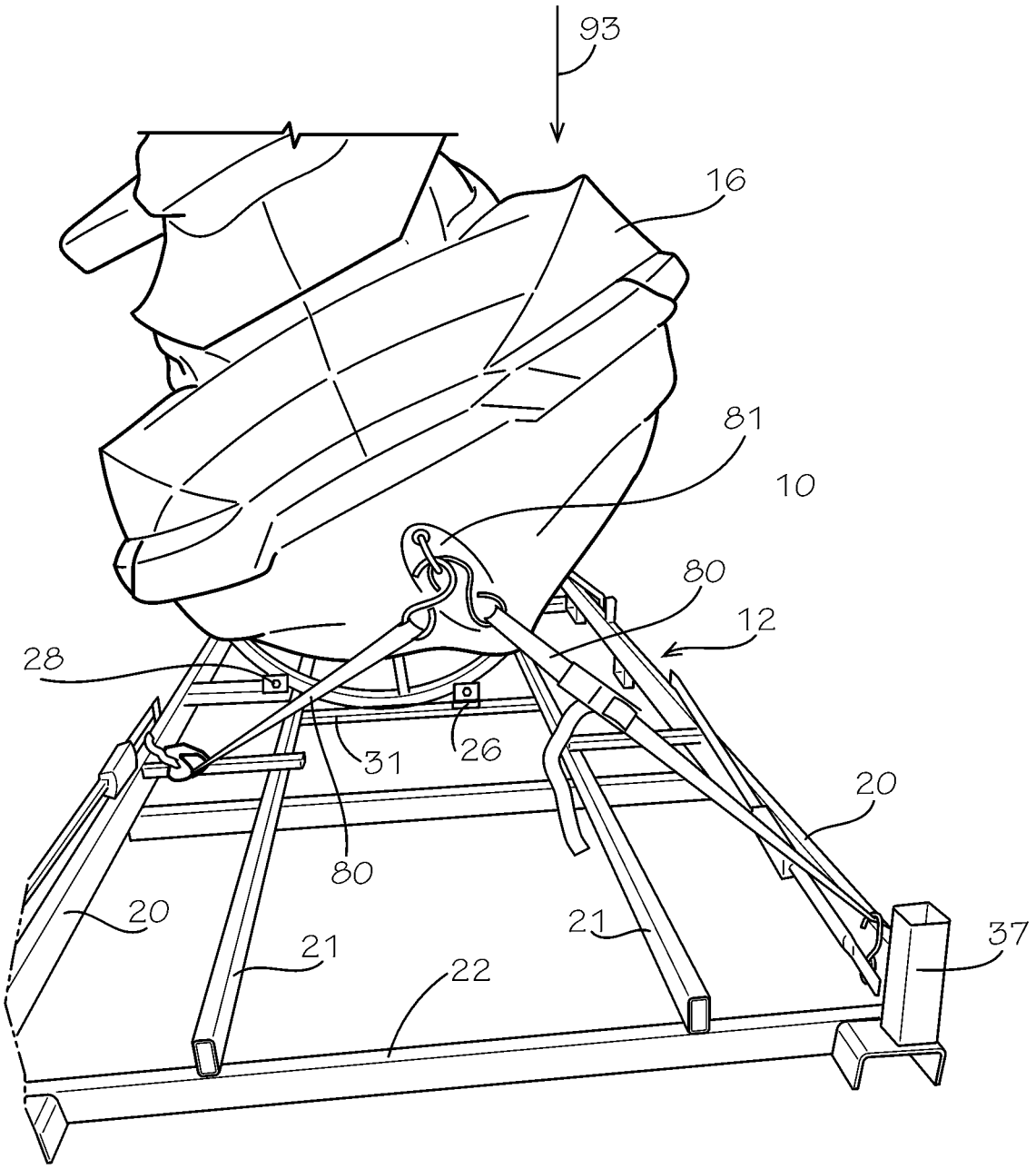
FIG. 7 illustrates a bow view showing a plurality of straps that secure the personal watercraft to the pallet.
Figure 8:
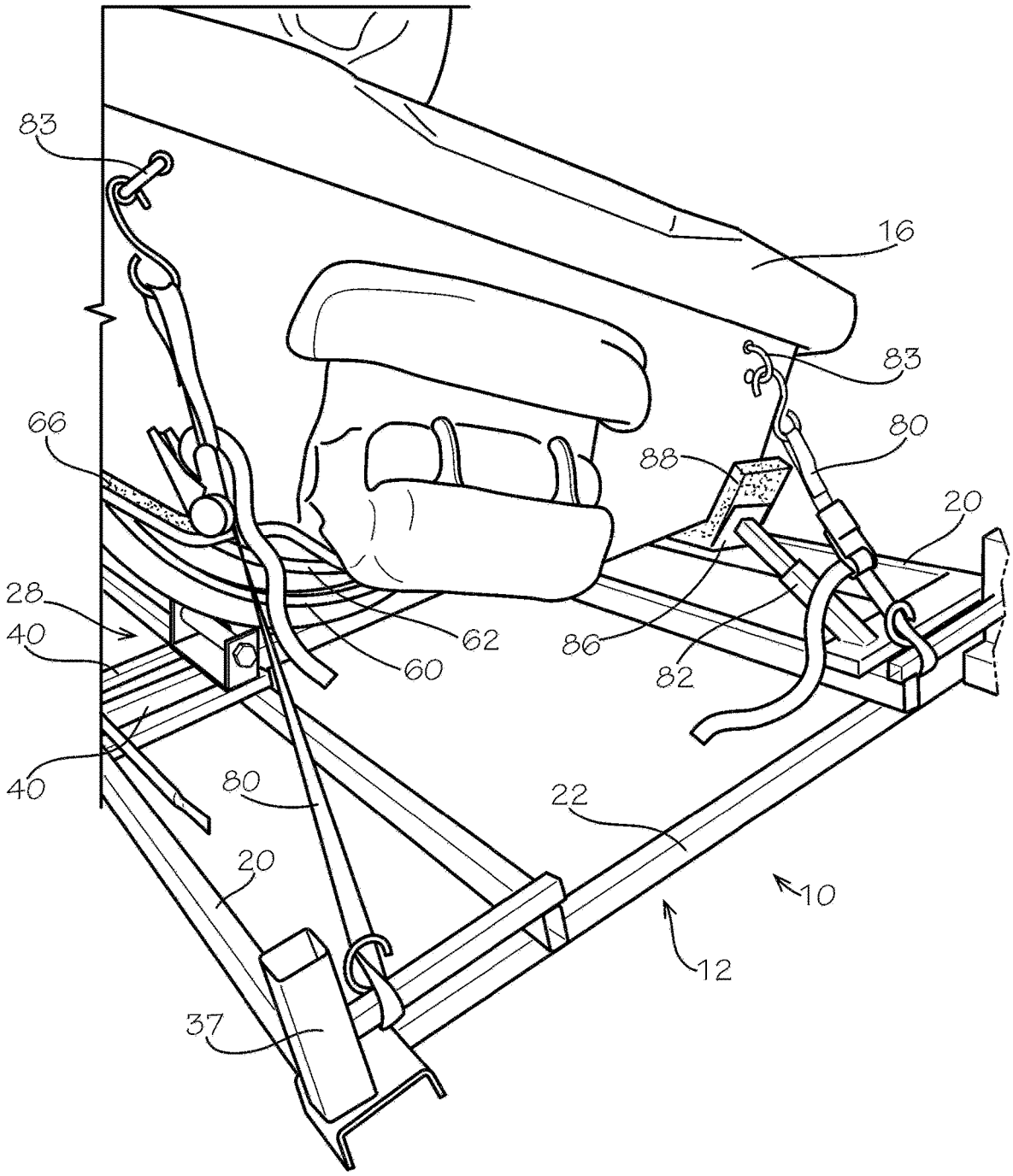
FIG. 8 illustrates a stern view showing a plurality of straps that secure the personal watercraft to the pallet.

The pallet 12 of the shipping container 10 holds the watercraft 16 for storage and shipping. FIG. 7 illustrate a bow view of the pallet 12 with a plurality of ratchet straps 80 connected to a bow cleat 81 and to the pallet 16 to secure the personal watercraft on the pallet within the shipping container. FIG. 8 illustrates in a stern view a plurality of the ratchet straps 80 connected to stern cleats 83 and to the pallet 12 to secure the personal watercraft on the pallet within the shipping container.

FIG. 9 illustrates a bow or front view of the shipping container 10 including the pallet 12 holding the personal watercraft 16 in the second orientation in which the transverse axis 33 of the watercraft is oriented at the oblique angle 35 relative to the pallet for storage and for shipping of the personal watercraft.

Typically, the handle bar and a side rear-view mirror (depicted in broken line in FIG. 9) of the watercraft 16 may extend outwardly of the envelope defined by the shipping container 10, and accordingly, are detached from the personal watercraft such as during packing for shipping and storage. The handle bar and side rear-view mirror are wrapped in separate packaging and secured within the envelop of the shipping container 10 for re-attachment after unpacking at a retailers.

With reference to FIGS. 5 and 6, the trusses 30 seat on the respective aligned and spaced guides 26, 28. The trusses 30 are placed in the first angled position (FIG. 5). The watercraft 16 is placed on the trusses 30 cushioned by the pad 66. The personal watercraft 16 may be lifted by a hoist or by use of fork prongs of a lift truck. The trusses 30 are then moved arcuately on the guides 26, 28. This is accomplished by pushing downwardly 91 (FIG. 6) on a side of the watercraft 16. The pushing load on the mass of the watercraft 16 causes the watercraft to rotate arcuately as the rails 60 move on the rotating thrust bearing sleeves 50. The distal end 37 of the truss 30 proximate the stop member 32 contacts the stop 34. The trusses 30 (and the watercraft 16) are thereby oriented at the oblique position such that the transverse axis 33 is at the oblique angle 35 to the pallet (see FIG. 1).

With reference to FIG. 4, the stern bracket 82 is installed by pushing the pad 88 on the end plate 86 against the stern of the watercraft and the arm 84 is rigidly secured to the pallet 12 such as with screws or bolts.

The watercraft 16 is then secured to the pallet 12. As illustrated in FIGS. 7 and 8, the plurality of straps 80 with ratchet latches connect from the watercraft 16 with hooks to portions of the pallet 12. Typical personal watercraft have the forward bow bracket 81, and for storage and shipping, hooks on the ends of the straps 80 engage the bracket and pallet 12, as shown in FIG. 7. The ratchet cinches the strap 80 to secure the watercraft 16 in a fixed position on the pallet 12 for transport and handling. Similarly, brackets (or cleats 83) are typically attached on opposing sides at the stern of the watercraft 16, and may be used for receiving cinching straps 80 to secure the watercraft for transport and handling as shown in FIG. 8.

With reference to FIG. 9, the H-frame end assemblies 19 attach to opposing ends of the pallet 12. Legs of the assemblies 19 insert into the receivers 35 attached to the corners of the pallet 12. The top frame 15 seats on the upper ends of the end assemblies 19. The plurality of side support members 13 attach at respective ends to the pallet 12 and the top frame 15, and/or alternatively, attach as diagonal supports between the end assemblies 19 and the pallet or top frame.

The secured watercraft 16 crated in the shipping container 10 may then be handled, such as by fork lift, for warehouse storage, or placed in a trailer for transport to a retailer.

At delivery to a retailer, the watercraft 16 is unpackaged from the shipping container 10. With reference to FIG. 9, the side support members 13 are detached and the top frame 15 removed. The end assemblies 19 are removed from the receivers 37. The securing straps 80 are detached. With reference to FIGS. 1 and 5, the trusses 30 of the pallet 12 are moved relative to the pallet between the angled orientation and the horizontal orientation. This is accomplished by pushing downwardly (93 shown in FIG. 7) on the side of the watercraft 16 to cause the watercraft to rotate axially. The trusses 30 move relative to the guides 26, 28 and the sleeves 50 axially rotate about the bolt 48. The watercraft 16 supported on the trusses 30 thereby rotates axially to the first, or horizontal, orientation. With the trusses 30 in the first position for supporting the watercraft 16 in the horizontal orientation, the watercraft is then hoisted from the pallet 12 for placing on a dolly or into a body of water, for display for sale or demonstration.

The travel surface of the truss preferably readily moves easily relative to the guides 26, 28, such as for example low coefficient of friction between the rail 60 as a sliding portion of the hull supporting truss and the rotating sleeve 50 of the guide members. Alternate embodiments may use a curved plywood member for the travel contact surface and the guides may have surfaces on which the travel contact surface slides, for example, plastic shims.

The foregoing discloses an illustrative embodiment of a shipping container readily usable in trucking to remote retailers of personal watercraft mounted at an angled orientation relative to a pallet of the shipping container while facilitating the handling of the personal watercraft in a horizontal orientation for uncrating of the watercraft for display and sale.

The forgoing discloses the present invention with exemplary embodiments presented for use within the container and shipping field and particularly relative to containing and shipping of personal watercraft. Those skilled in the art, having benefit of this disclosure, will appreciate that other embodiments of the apparatus and other application of the methods may be devised which do not depart from the scope of the invention as disclosed here. Accordingly, the scope of the invention should be limited only by the appended claims.

What is claimed is:

1. A shipping container, comprising:

a pallet;

a first pair of roller guides and a second pair of roller guides, the first pair and the second pair of roller guides spaced apart intermediate opposing ends of the pallet;

each of the roller guides comprises:

a pair of spaced-apart plates;

a shaft extending between the plates; and a sleeve received on the shaft for axial rotation; and a pair of trusses each removably received on a respective one of the first pair of roller guides and the second pair of roller guides, the trusses movable on the respective sleeves that rotate during movement of the truss between a first position for loading or unloading the personal watercraft seated on the trusses and a second position for storing and transporting of a personal watercraft thereon at an oblique angle relative to the pallet.

2. The shipping container as recited in claim 1, further comprising a stop extending from the pallet proximate one of the roller guides for stopping the movement of the trusses on the roller guides to the first position.

3. The shipping container as recited in claim 1, wherein one of the trusses includes a portion that contacts the stop when the one truss moves on the one of the pair of roller guides to the first position.

4. The shipping container as recited in claim 1, further comprising a plurality of elongated straps, each for connecting between the pallet and the personal watercraft for securing the personal watercraft to the pallet.

5. The shipping container as recited in claim 1, wherein the truss comprises a rail and a chock connected in spaced relation by at least one span, the rail traveling on the roller guides between the first position and the second position.

6. The shipping container as recited in claim 5, wherein the chock for supporting of the personal watercraft conforms in shape to a transverse cross-sectional exterior portion of the personal watercraft.

7. The shipping container as recited in claim 5, wherein the chock defines an arcuate portion for orientation of the personal watercraft held on the cradle in the first position and the second position.

8. The shipping container as recited in claim 5, further comprising a travel surface on the rail for moving on the roller guides.

9. The shipping container as recited in claim 8, wherein the travel surface comprises a low friction member for facilitating movement of the truss relative to the roller guides between the first position and the second position.

10. The shipping container as recited in claim 1, further comprising a resilient pad disposed on the truss for cushioningly contacting an exterior surface of the personal watercraft.

11. The shipping container as recited in claim 9, wherein the resilient pad comprises a polymeric foam.

12. The shipping container as recited in claim 1, further comprising a stern brace comprising an arm extending from the pallet and having a stern pad attached at a free distal end for bearing contact against a stern of the personal watercraft, for resisting movement of the personal watercraft during handling and shipping of the shipping container.

13. The shipping container as recited in claim 12, wherein the stern pad comprises an L-shaped seat having a first leg for extending underneath a portion of the stern of the personal watercraft and a second leg for facing the stern; and a resilient pad connected to the seat for contacting respective portions of the stern of the personal watercraft.

14. The shipping container as recited in claim 1, further comprising a pair of opposing end frames attached to respective ends of the pallet; and a top frame attached to the end frames.

15. The shipping container as recited in claim 14, further comprising a plurality of side support members disposed in spaced apart relation on opposing longitudinal sides between the opposing ends of the pallet and connected at respective ends to the pallet and the top frame.

16. The shipping container as recited in claim 15, wherein at least one of the side support members on each of the opposing sides is disposed at an oblique angle relative to the pallet.

17. The shipping container as recited in claim 14, further comprising a plurality of elongate support members each attached at an oblique angle relative to the pallet at respective opposing ends to one of the end frames and to the pallet.

18. A method of containing a personal watercraft in a shipping container for storage and shipping, comprising the steps of:

(a) providing a pallet having a first pair of roller guides and a second pair of roller guides, the first pair and the second pair of the roller guides attached in spaced apart relation intermediate opposing ends of the pallet, each of the roller guides comprises a pair of spaced-apart plates, a shaft extending between the plates, and a sleeve received on the shaft for axial rotation;

(b) placing one of a pair of trusses on a respective one of the first pair of roller guides and the second pair of roller guides in a first position for loading or unloading the personal watercraft thereon, the trusses movable on the sleeves from the first position to a second position for orienting a transverse axis of the personal watercraft at an oblique angle relative to the pallet for storing and transporting of the personal watercraft seated on the trusses; and (c) securing the personal watercraft received on the trusses to the pallet.

19. The method as recited in claim 18, further comprising the step of moving the trusses from the first position to the second position to dispose the personal watercraft at the oblique angle relative to the pallet.

20. The method as recited in claim 18, wherein securing comprises the step of attaching a plurality of elongated straps to the pallet and the personal watercraft.

21. The shipping container as recited in claim 1, wherein the roller guides of the first pair of roller guides are positioned on the pallet transversely aligned and spaced-apart; and the roller guides of the second pair of roller guides are positioned on the pallet transversely aligned and spaced-apart.

22. A shipping container, comprising:

a pallet;

a first pair of roller guides and a second pair of roller guides, the first pair and the second pair of roller guides spaced apart intermediate opposing ends of the pallet; and a pair of trusses each removably received on a respective one of the first pair of roller guides and the second pair of roller guides, each truss comprises a rail and a chock connected in spaced relation by at least one span, the rail traveling on the roller guides, whereby the trusses movable from a first position for loading or unloading the personal watercraft seated on the trusses and a second position for storing and transporting of a personal watercraft thereon at an oblique angle relative to the pallet.

23. The shipping container as recited in claim 22, wherein the chock for supporting of the personal watercraft conforms in shape to a transverse cross-sectional exterior portion of the personal watercraft.

24. The shipping container as recited in claim 22, wherein the chock defines an arcuate portion for orientation of the personal watercraft held on the cradle in the first position and the second position.

25. The shipping container as recited in claim 22, further comprising a travel surface on the rail for moving on the roller guide member.

26. The shipping container as recited in claim 25, wherein the travel surface comprises a low friction member for facilitating movement of the truss relative to the roller guides between the first position and the second position.

27. The shipping container as recited in claim 22, further comprising a resilient pad disposed on the truss for cushioningly contacting an exterior surface of the personal watercraft.

28. The shipping container as recited in claim 27, wherein the resilient pad comprises a polymeric foam.

29. A shipping container, comprising:

a pallet;

a first pair of roller guides and a second pair of roller guides, the first pair and the second pair of roller guides spaced apart intermediate opposing ends of the pallet; and a pair of trusses each removably received on a respective one of the first pair of roller guides and the second pair of roller guides, the trusses movable from a first position for loading or unloading the personal watercraft seated on the trusses and a second position for storing and transporting of a personal watercraft thereon at an oblique angle relative to the pallet; and a pair of resilient pads, each disposed on a respective one of the pair of trusses for cushioningly contacting an exterior surface of the personal watercraft.

30. The shipping container as recited in claim 29, wherein the resilient pad comprises a polymeric foam.

31. A shipping container, comprising:

a pallet;

a first pair of roller guides and a second pair of roller guides, the first pair and the second pair of roller guides spaced apart intermediate opposing ends of the pallet; and a pair of trusses each removably received on a respective one of the first pair of roller guides and the second pair of roller guides, the trusses movable from a first position for loading or unloading the personal watercraft seated on the trusses and a second position for storing and transporting of a personal watercraft thereon at an oblique angle relative to the pallet; and a stern brace comprising an arm extending from the pallet and having a stern pad attached at a free distal end for bearing contact against a stern of the personal watercraft, for resisting movement of the personal watercraft during handling and shipping of the shipping container.

32. The shipping container as recited in claim 31, wherein the stern pad comprises an L-shaped seat having a first leg for extending underneath a portion of the stern of the personal watercraft and a second leg for facing the stern; and a resilient pad connected to the seat for contacting respective portions of the stern of the personal watercraft.

33. A shipping container, comprising:

a pallet;

a first pair of roller guides and a second pair of roller guides, the first pair and the second pair of roller guides spaced apart intermediate opposing ends of the pallet; and a pair of trusses each removably received on a respective one of the first pair of roller guides and the second pair of roller guides, the trusses movable from a first position for loading or unloading the personal watercraft seated on the trusses and a second position for storing and transporting of a personal watercraft thereon at an oblique angle relative to the pallet;

a pair of opposing end frames attached to respective ends of the pallet;

a top frame attached to the end frames; and a plurality of side support members disposed in spaced apart relation on opposing longitudinal sides between the opposing ends of the pallet and connected at respective ends to the pallet and the top frame, and wherein at least one of the side support members on each of the opposing sides is disposed at an oblique angle relative to the pallet.

34. A shipping container, comprising:

a pallet;

a first pair of roller guides and a second pair of roller guides, the first pair and the second pair of roller guides spaced apart intermediate opposing ends of the pallet; and a pair of trusses each removably received on a respective one of the first pair of roller guides and the second pair of roller guides, the trusses movable from a first position for loading or unloading the personal watercraft seated on the trusses and a second position for storing and transporting of a personal watercraft thereon at an oblique angle relative to the pallet;

a pair of opposing end frames attached to respective ends of the pallet;

a top frame attached to the end frames; and a plurality of elongate support members each attached at an oblique angle relative to the pallet at respective opposing ends to one of the end frames and to the pallet.

* * * * *